US007893908B2

(12) United States Patent
Morimoto et al.

(10) Patent No.: US 7,893,908 B2
(45) Date of Patent: Feb. 22, 2011

(54) LIQUID CRYSTAL DISPLAY DEVICE AND LIQUID CRYSTAL PANEL DRIVE METHOD

(75) Inventors: Takeshi Morimoto, Tokyo (JP); Reiichi Kobayashi, Tokyo (JP)

(73) Assignee: NEC Display Solutions, Ltd., Minato-ku, Tokyo (JP)

( * ) Notice: Subject to any disclaimer, the term of this patent is extended or adjusted under 35 U.S.C. 154(b) by 967 days.

(21) Appl. No.: 11/797,087

(22) Filed: Apr. 30, 2007

(65) Prior Publication Data

US 2007/0262940 A1 Nov. 15, 2007

(30) Foreign Application Priority Data

May 11, 2006 (JP) ..... 2006-132364

(51) Int. Cl.
*G09G 3/36* (2006.01)

(52) U.S. Cl. ..... 345/94; 345/87; 345/98; 345/100; 345/102; 345/89

(58) Field of Classification Search ..... 345/76, 345/87–102, 204, 205, 211, 213, 690; 324/71.3, 324/770; 349/39, 187, 191; 348/254, 674; 250/205, 214 AL
See application file for complete search history.

(56) References Cited

U.S. PATENT DOCUMENTS 5,796,384 A 8/1998 Kim
5,854,616 A * 12/1998 Ota et al. ..... 345/100
6,520,643 B1 * 2/2003 Holman et al. ..... 353/20
6,650,311 B1 11/2003 Mori
7,495,679 B2 * 2/2009 Chou ..... 345/690
7,605,788 B2 * 10/2009 Kamada et al. ..... 345/89
2002/0044126 A1 4/2002 Aoki
2003/0034941 A1 * 2/2003 Janssen et al. ..... 345/87
2004/0046724 A1 * 3/2004 Woo et al. ..... 345/87
2005/0057470 A1 * 3/2005 Tobita ..... 345/89
2005/0078101 A1 * 4/2005 Shigeta ..... 345/204

(Continued)

FOREIGN PATENT DOCUMENTS

JP 2-142513 5/1990

(Continued)

OTHER PUBLICATIONS

Japanese Office Action dated Jun. 11, 2008 with partial English translation.

(Continued)

*Primary Examiner*—Prabodh M Dharia
(74) *Attorney, Agent, or Firm*—McGinn IP Law Group, PLLC

(57) ABSTRACT

A liquid crystal display device includes a liquid crystal panel including a plurality of liquid crystal cells, a common voltage generation circuit that supplies a common voltage to the liquid crystal panel, a liquid crystal drive circuit that implements control for supplying the plurality of liquid crystal cells with voltage that accords with a video signal to display an image on the liquid crystal panel, and for reversing a polarity of the voltage supplied to the plurality of liquid crystal cells, and an adjustment module that stores characteristics data for correcting fluctuations in brightness and, based on the characteristics data, adjusts the brightness of the image displayed on the liquid crystal panel.

7 Claims, 8 Drawing Sheets

U.S. PATENT DOCUMENTS

| | | | | |
|---|---|---|---|---|
| 2005/0140632 | A1* | 6/2005 | Tsuda et al. | 345/92 |
| 2005/0184950 | A1 | 8/2005 | Nii | |
| 2005/0259061 | A1 | 11/2005 | Aoki | |
| 2006/0055648 | A1* | 3/2006 | Kamada et al. | 345/87 |
| 2007/0052735 | A1* | 3/2007 | Chou | 345/690 |
| 2007/0247478 | A1* | 10/2007 | Hagino et al. | 345/698 |

FOREIGN PATENT DOCUMENTS

| | | |
|---|---|---|
| JP | 2-184891 | 7/1990 |
| JP | 4-142513 | 5/1992 |
| JP | 5-19720 | 1/1993 |
| JP | 5-80713 | 4/1993 |
| JP | 10-313416 | 11/1998 |
| JP | 10-313417 | 11/1998 |
| JP | 10-313418 | 11/1998 |
| JP | 3033912 | 2/2000 |
| JP | 2000-221925 | 8/2000 |
| JP | 2001-201732 | 7/2001 |
| JP | 2001-343956 | 12/2001 |
| JP | 2002-182622 | 6/2002 |
| JP | 2002-229529 | 8/2002 |
| JP | 2003-241721 | 8/2003 |
| JP | 2004-20657 | 1/2004 |
| JP | 2005-241835 | 9/2005 |
| JP | 2006-99034 | 4/2006 |

OTHER PUBLICATIONS

Chinese Office Action dated Jun. 12,2009, with English translation.
Japanese Office Action dated Sep. 9, 2009, with partial English translation.
European Search Report dated Apr. 6, 2010.

* cited by examiner

LIQUID CRYSTAL DISPLAY DEVICE AND LIQUID CRYSTAL PANEL DRIVE METHOD

This application is based upon and claims the benefit of priority from Japanese Patent Application No. 2006-132364 filed in Japan Patent Office on May 11, 2006, the contents of which are hereby incorporated by reference.

BACKGROUND OF THE INVENTION

1. Field of the Invention

The present invention relates to a liquid crystal display device that employs a liquid crystal panel, of which a liquid crystal projector is representative, and more particularly, to a liquid crystal display device in which a common voltage is supplied to common electrodes to which a plurality of liquid crystal cells are connected in common.

2. Description of the Related Art

As a countermeasure against deterioration of liquid crystals in a liquid crystal display device, an alternating current (AC) drive is implemented in which the polarity of voltage that is applied to the liquid crystals reverses at a prescribed cycle. Such alternating current drives may include, for example, a dot-reversal drive, line-reversal drive, and frame-reversal drive. A liquid crystal display device is driven by one or a combination of a plurality of these drives.

FIG. 1A shows the waveform of image data of a line-reversal drive. Taking reference voltage Vref as a standard, the image data shown in FIG. 1A alternate with each horizontal scanning period between image data of positive polarity and image data of negative polarity for which polarity is reversed. In a line-reversal drive, the polarity of a video signal reverses with each horizontal scanning period, as shown in FIG. 1A. Image data of positive polarity and image data of negative polarity are vertically symmetrical about reference voltage Vref. Common voltage Vcom is a voltage applied to the common electrodes of each liquid crystal cell, and this common voltage is regulated to minimize flicker (fluctuation in brightness) that is generated by the reversal of image data (e.g., see JP-A-2004-020657 (hereinbelow referred to as "Patent Document 1")).

FIG. 2 shows an equivalent circuit of, for example, a liquid crystal cell of a liquid crystal panel in which an AC drive is implemented. The circuit may include image data line L1 and gate lines L2 and L3.

A thin film transistor (TFT) is provided in the portion of intersection between image data line L1 and gate line L2. CLC is the capacitance of the liquid crystal cell, CS is the added capacitance, and CGD is the parasitic capacitance between the gate and drain of the TFT. When a voltage is applied to an object liquid crystal cell (e.g., when writing a video signal), gate line L2 becomes "high" and the TFT becomes conductive.

After writing the video signal, gate line L2 becomes "Low," following which the written video signal is held. When gate line L2 switches from "High" to "Low," the liquid crystal cell voltage VLC drops due to the differential effect of the parasitic capacitance CGD. The amount of drop in voltage is uniform without any dependence on the polarity of the video signal. In addition, due to the drop in voltage that results from the combined capacitance of the liquid crystal cell capacitance CLC and the added capacitance CS, common voltage Vcom attains the optimum adjustment value at a voltage that is lower than reference voltage Vref, which is the central value of the image data.

Nematic liquid crystal used in a liquid crystal display device typically has a rod shape and further has a dielectric anisotropy in which the dielectric constant in the direction of the major axis is greater than the dielectric constant in the direction of the minor axis. The liquid crystal molecules are arranged in a substantially horizontal state when in a state in which voltage is not applied, but assume an increasingly vertical state according to the degree of voltage applied. In this way, the dielectric constant varies according to the applied voltage.

When the dielectric constant changes, the electrostatic capacitance also changes. The potential of a liquid crystal cell comes under the influence of the stray capacitance between the gate and drain of the TFT and the combined capacitance of the liquid crystal capacitance and the added capacitance, and the common voltage is adjusted by a voltage that, to the degree of the amount of drop in voltage of the combined capacitance, is lower than the liquid crystal cell potential. The voltage drop of the combined capacitance is changed by the voltage applied to the liquid crystal cell (e.g., image data).

FIG. 3 shows a block diagram of a liquid crystal panel driver that adopts a line-reversal drive. Referring to FIG. 3, the liquid crystal panel driver includes V-T/gamma correction circuit 100, liquid crystal drive circuit 101, and common voltage generation circuit 102.

V-T/gamma correction circuit 100 is composed of: V-T correction circuit for correcting the voltage (V)—transmittance (T) characteristic of the liquid crystal panel, which is represented by an S-shaped curve, to a linear characteristic (in which V changes proportionally with respect to T); and a gamma correction circuit for correcting the input/output characteristic to a non-linear form.

Typically, this V-T correction circuit and gamma correction circuit can both be made up from look-up tables (hereinbelow abbreviated as "LUT"). The V-T correction circuit and gamma correction circuit may be realized as two LUTs for separately storing correction data used in the two correction circuits, or may be realized as a single LUT for storing correction data capable of both corrections. Japanese Patent number 3033912 (hereinbelow referred to as "Patent Document 2") discloses a case in which V-T correction circuit and gamma correction circuit are realized as a single LUT.

A video signal that has undergone V-T/gamma correction by V-T/gamma correction circuit 100 is supplied to liquid crystal drive circuit 101. In liquid crystal drive circuit 101, the video signal from V-T/gamma correction circuit 100 is subjected to line reversal and frame reversal processing. The video signal that has undergone line reversal-frame reversal in liquid crystal drive circuit 101 is then supplied to liquid crystal panel 103. In liquid crystal panel 103, common voltage is supplied from common voltage generation circuit 102.

In the liquid crystal panel driver described in the foregoing explanation, the combined use of line-reversal drive and frame-reversal drive in which line data of positive polarity and line data of negative polarity are switched with each frame can eliminate noticeable flicker even when the adjustment of common voltage Vcom diverges somewhat from the optimum value.

FIG. 1B shows the waveform of image data in the $N^{th}$ frame of frame-reversal drive, and FIG. 1C shows the waveform of image data in the $(N+1)^{th}$ frame. In frame-reversal drive, the image data of FIGS. 1B and 1C are reversed with each frame. Within the same frame, the waveform of image data of each line is a waveform of the same polarity.

In addition, a "double speed drive system" is also known in which, in frame-reversal drive, a liquid crystal panel is driven at twice the drive frequency of the input video signal (e.g., see JP-A-2006-099034 (hereinbelow referred to as "Patent Document 3")).

In frame-reversal drive, differences in luminance occur in frame units and the frequency at which flicker occurs (with respect to frame frequency) is therefore low. Flicker for which the frequency of occurrence is low is problematic because it is readily apparent to the human eye.

In contrast, using the frame-reversal double-speed drive system to drive a liquid crystal panel at twice the drive frequency of the input video signal increases the frequency of generation of flicker compared to normal frame reversal drive and can therefore be assumed to render flicker difficult to discern according to the capabilities of the human eye. In the latest high-luminance projectors, however, flicker becomes more readily noticeable with the increase in brightness, even when the frame-reversal double-speed drive system is adopted. The reasons for this problem are described below.

Assuming the frequency of occurrence of flicker is fixed, according to the characteristics of human vision, flicker becomes more easily discernible in proportion to the increase in luminance of the screen. Increasing the angle of field also makes flicker more noticeable. For example, when viewing an image projected onto a screen from the latest high-luminance projector, flicker is more easily noticeable when viewed from a position close to the screen than when viewed from a position far from the screen. Flicker may therefore be noticed when viewing a projected image from a position close to the screen even with a high-luminance projector that adopts the frame-reversal double-speed drive system.

In addition, when the common voltage is not appropriate, giving rise to a difference between the potential of liquid crystal cells and the standard voltage (e.g., reference voltage) that is the standard for the reversal of image data of positive polarity and negative polarity, the difference between the brightness of display images that are based on image data of positive polarity and the brightness of display images that are based on image data of negative polarity increases, and flicker becomes more easily noticed. Normally, in a projector in which the AC drive system is adopted, the projected image is rated by visual inspection or by measuring equipment and the common voltage then adjusted to minimize the amount of flicker.

That is, the common voltage is adjusted and balance established for the voltage applied to the liquid crystal cells by means of the time interval of the application of image data of positive polarity and the time interval of the application of image data of negative polarity, whereby the difference in brightness between the image data of positive polarity and the image of negative polarity is minimized. However, the combined capacitance of the liquid crystal cell capacitance and the added capacitance differ due to the amplitude and polarity of the image data, and as a result, when the common voltage is uniform, a minute difference will inevitably occur between the brightness of displayed images that are based on image data of positive polarity and the brightness of displayed images that are based on image data of negative polarity. This minute difference in brightness is one cause of noticeable flicker.

It is further believed that flicker that is produced by the difference between the common voltage and standard voltage (e.g., reference voltage) can be limited by rapidly modulating the common voltage at, for example, the frame frequency. However, the high-speed modulation of the common voltage is problematic, first because confronting electrodes to which the common voltage is supplied are common to all of the liquid crystal cells, resulting in high electrostatic capacity, and further, because of the low carrier mobility of the silicon material of the wiring portion of the TFT substrate.

In the invention described in Patent Document 1, uniformly adjusting flicker over the entire surface enables a solution to the problem that the optimum value of the common voltage for minimizing flicker differs for the central portion and peripheral portions of the liquid crystal panel. However, Patent Document 1 makes no disclosure regarding the configuration for limiting the occurrence of flicker during frame-reversal double-speed drive. Suppression of the occurrence of flicker during frame-reversal double-speed drive is therefore a problem in the invention disclosed in Patent Document 1.

In the invention disclosed in Patent Document 2, V-T correction and gamma correction can be realized by a simple configuration. However, the invention described in Patent Document 2 does not have a configuration for suppressing the occurrence of flicker during frame-reversal double-speed drive.

Patent Document 3 discloses a method for adjusting the common voltage so as to minimize flicker during frame-reversal double-speed drive, but the danger remains that merely suppressing the occurrence of flicker by adjusting the common voltage leaves open the potential for noticeable flicker and a drop in the quality of displayed images.

SUMMARY OF THE INVENTION

In view of the foregoing and other problems, disadvantages, and drawbacks of the related art, it is a purpose of the present invention to provide a liquid crystal display device that may solve the above-described problems and may enable a suppression of the occurrence of flicker during AC drive.

To achieve the above-described purpose, an exemplary aspect of the present invention is directed to a liquid crystal display device which may include a liquid crystal panel including a plurality of liquid crystal cells, a common voltage generation circuit that may supply a fixed common voltage to common electrodes to which the plurality of liquid crystal cells are connected in common, and a liquid crystal drive circuit that may implement control both for supplying the plurality of liquid crystal cells with voltage that accords with a video signal supplied as input from the outside to display images on the liquid crystal panel, and for reversing the polarity of the voltage supplied to the plurality of liquid crystal cells at a prescribed period.

In this exemplary aspect, the liquid crystal display device may also include an adjustment module that may include a memory module for storing characteristics data for correcting fluctuations in brightness that originate from the polarity and amplitude of voltage supplied to the liquid crystal cells, and, based on the characteristics data, may adjust the brightness of display images that are based on image data of positive polarity for which the polarity of the voltage is taken as positive and the brightness of display images that are based on image data of negative polarity for which the polarity of the voltage is taken as negative.

The above-described liquid crystal display device of the present invention may include a configuration that renders flicker difficult to discern through the adjustment by means of the adjustment module of the balance of the brightness of display images that are based on image data of positive polarity and the brightness of display images that are based on image data of negative polarity based on characteristics data that have been obtained in advance.

The optimum value of the common voltage may change according to the polarity and amplitude of image data. Thus, in a configuration in which a fixed DC voltage is supplied as the common voltage, fluctuation may occur in the brightness when there is a great amount of shift in the potential applied to liquid crystal cells at times when the image data is of positive polarity and at times when the image data is of negative polarity, and as a result, flicker becomes easily discernible. According to an exemplary aspect of the present invention, the adjustment module may implement adjustment such that little difference occurs in brightness between display images that are based on image data of positive polarity and display images that are based on image data of negative polarity, whereby flicker becomes difficult to discern.

The present invention as described hereinabove may suppress the occurrence of flicker in frame-reversal double-speed drive, and thus may provide a high-quality image in which flicker is difficult to discern in a high-luminance liquid crystal display device that employs the frame-reversal double-speed drive system.

BRIEF DESCRIPTION OF THE DRAWINGS

The foregoing and other objects, aspects and advantages will be better understood from the following detailed description of exemplary embodiments of the invention with reference to the drawings, in which.

DETAILED DESCRIPTION OF THE EXEMPLARY EMBODIMENTS OF THE INVENTION

First Embodiment

Figure 4:
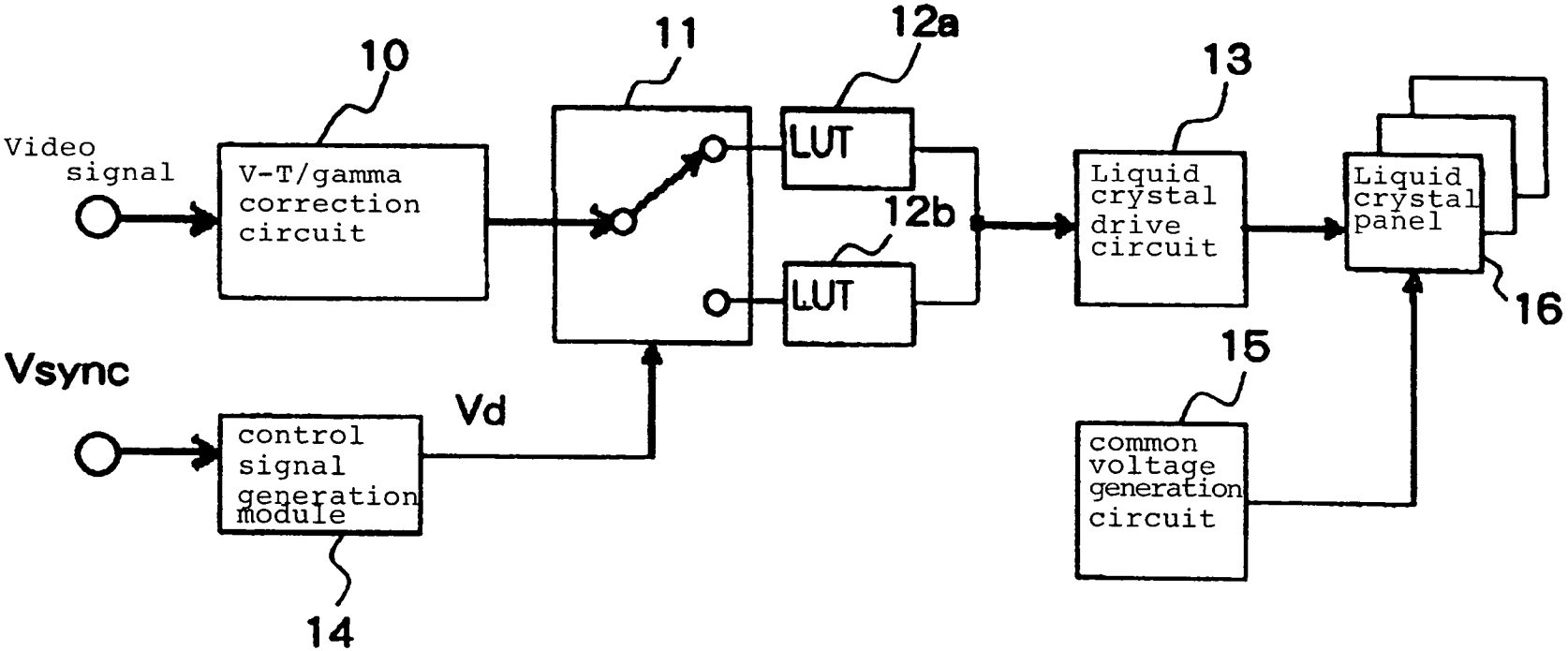
FIG. 4 is a block diagram showing the schematic configuration of a liquid crystal panel drive module of the liquid crystal display device, according to the first embodiment of the present invention.

FIG. 4 is a block diagram showing the schematic configuration of the liquid crystal panel drive module of the liquid crystal display device that is the first exemplary embodiment of the present invention.

Figure 1A:
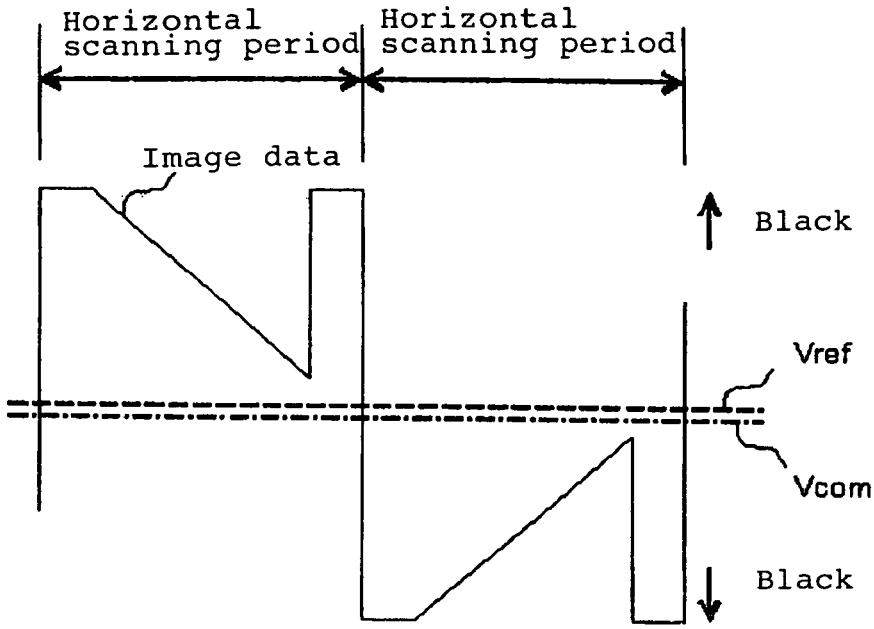
Fig. 1A (Related Art)
FIG. 1A shows the waveform of image data of line-reversal drive.
Figure 1B:
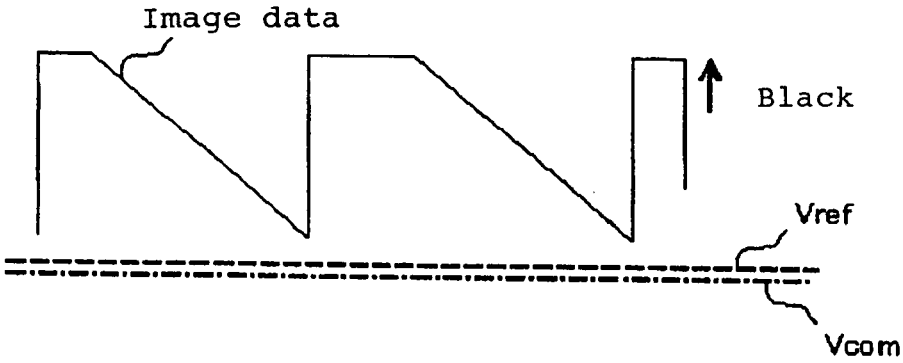
Fig. 1B (Related Art)
FIG. 1B shows the waveform of image data in the $N^{th}$ frame of frame-reversal drive.
Figure 1C:
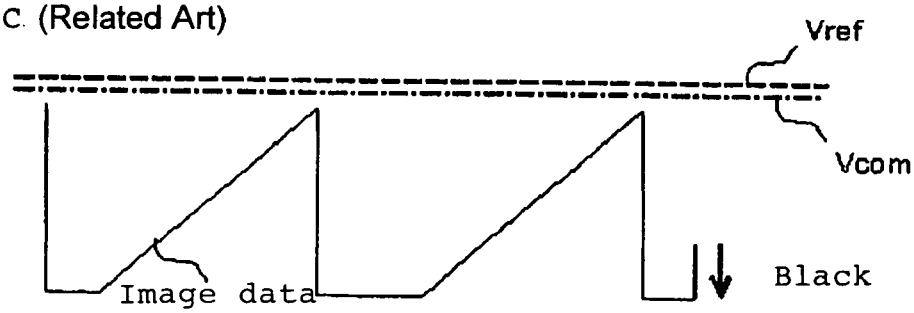
Fig. 1C (Related Art)
FIG. 1C shows the waveform of image data in the $(N+1)^{th}$ frame of frame-reversal drive.
Figure 2:
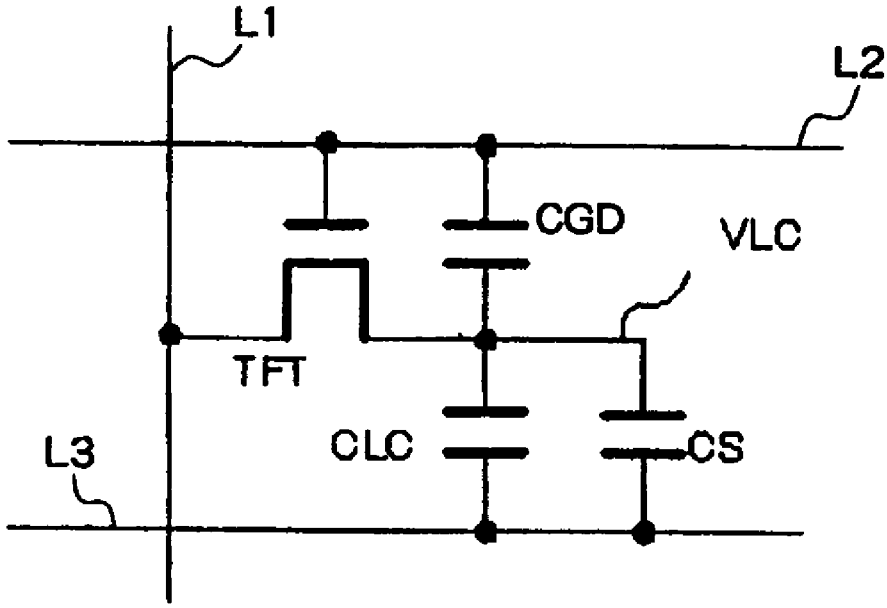
Fig. 2 (Related Art)
FIG. 2 shows an example of a liquid crystal panel.

Referring to FIG. 4, the liquid crystal panel drive module may drive liquid crystal panel 16, and may include as its principal components: V-T/gamma correction circuit 10; switch circuit 11, look-up tables (LUTs) 12*a* and 12*b*; liquid crystal drive circuit 13, control signal generation module 14; and common voltage generation circuit 15. Liquid crystal panel 16 may include a ready-made liquid crystal panel and may be, for example, the same as the liquid crystal panel shown in FIG. 2. Switch circuit 11 and look-up tables (LUTs) 12*a* and 12*b* may include components for adjusting the brightness of the display image (e.g., may include an adjustment module).

Figure 3:
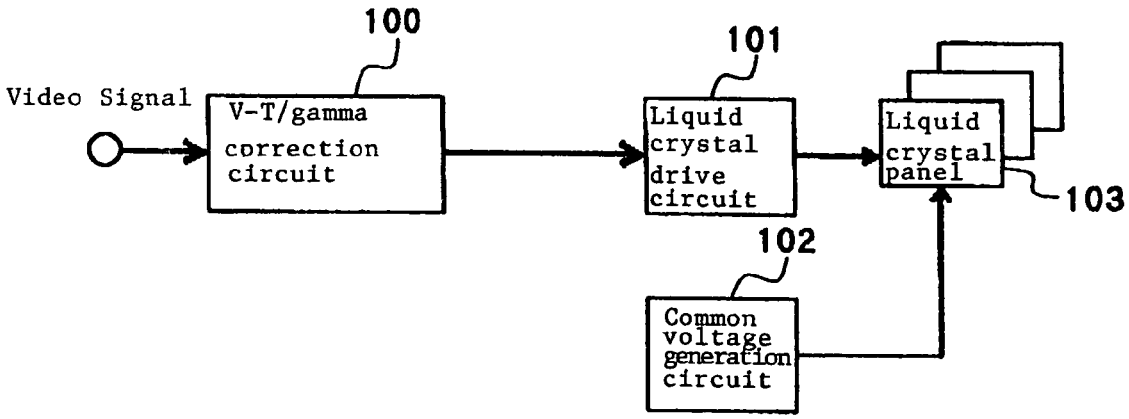
Fig. 3 (Related Art)
FIG. 3 is a block diagram showing the configuration of a liquid crystal panel drive device that employs line-reversal drive.

V-T/gamma correction circuit 10 may be of the same configuration as V-T/gamma correction circuit 100 shown in FIG. 3, and may be provided with a V-T correction circuit and a gamma correction circuit that are composed of LUTs. V-T/gamma correction circuit 10 may carry out V-T/gamma correction of a video signal supplied from the outside. The video signal that has undergone V-T/gamma correction may be supplied to the input of switch circuit 11.

Based on a timing signal Vd from control signal generation module 14, switch circuit 11 switches the output destination of the video signal received as input from V-T/gamma correction circuit 10 to either of a first and a second output. The first output is supplied to LUT 12*a*, and the second output is supplied to LUT 12*b*.

Data for adjusting the brightness of display images that are based on image data of positive polarity may be stored in advance in LUT 12*a*, and data for adjusting the brightness of display images that are based on image data of negative polarity are stored in advance in LUT 12*b*. Adjusting the balance of the brightness of display images that are based on image data of positive polarity and display images that are based on image data of negative polarity by means of these LUTs 12*a* and 12*b* may enable the suppression of flicker that is produced by the difference between the value of the standard voltage that is the standard for reversal of image data of positive polarity and image data of negative polarity and the value of the common voltage that is supplied as output from common voltage generation circuit 15.

Control signal generation module 14 may generate timing signal Vd that is an integer multiple (a positive integer multiple, normally "2") of the vertical synchronizing signal Vsync that indicates the frame period of the video signal from the outside. The timing signal Vd generated by control signal generation module 14 may be supplied to switch circuit 11. The switching of positive polarity LUT 12*a* and negative polarity LUT 12*b* may be carried out based on this timing signal Vd.

Common voltage generation circuit 15 generates common voltage Vcom that may be applied to the common electrodes of each liquid crystal cell of liquid crystal panel 16. The value of common voltage Vcom may be adjusted in advance to minimize flicker that is generated by the reversal of the image data. As one method that can be considered for adjusting common voltage Vcom, synchronization of measuring equipment may be first obtained by means of timing signal Vd, each of the brightness of display images relating to image data (e.g., frames) of positive polarity and the brightness of display images relating to image data (e.g., frames) of negative polarity are measured by the measuring equipment, and common voltage Vcom then adjusted to minimize the difference between the two brightness values. Alternatively, a signal in which positive polarity is all white and negative polarity is all black and a signal in which positive polarity is all black and negative polarity is all white may be prepared, following which common voltage Vcom may be adjusted to minimize the difference in brightness between the images that are displayed by the two signals.

Liquid crystal drive circuit 13 may implement control both for supplying to each liquid crystal cell of liquid crystal panel 16 voltage that accords with image data that have been supplied by way of LUTs 12*a* and 12*b* to display an image on liquid crystal panel 16, and for reversing the polarity of voltage supplied to each liquid crystal cell at a frequency that is an integer multiple of the frame frequency of the video signal.

Although not shown in FIG. 4, a polarity-reversing circuit for reversing the polarity of voltage supplied to each liquid crystal cell of liquid crystal panel 16 may be provided in the stage succeeding liquid crystal drive circuit 13, and liquid crystal drive circuit 13 may send a control signal (a signal that serves as a trigger) for causing this polarity-reversing circuit to operate. This control signal may be synchronized with timing signal Vd that is generated in control signal generation module 14, and polarity-reversing circuit therefore may reverse the polarity of the voltage supplied to each liquid crystal cell of liquid crystal panel 16 at a period that is determined by timing signal Vd.

The following explanation discusses the details of the data that may be stored in LUTs 12*a* and 12*b*.

Normally, it is known at the time of shipment of a product that a minute difference will occur between the brightness of image data of positive polarity and image data of negative polarity due to the liquid crystal characteristics or the inadequacy of the detection accuracy of flicker in the adjustment of the common voltage. Accordingly, characteristics data that differ according to this minute difference may be stored in LUTs 12*a* and 12*b* for adjusting the balance of the brightness of the display images that are based on the image data of positive polarity and the display images that are based on the image data of negative polarity.

Figure 5:
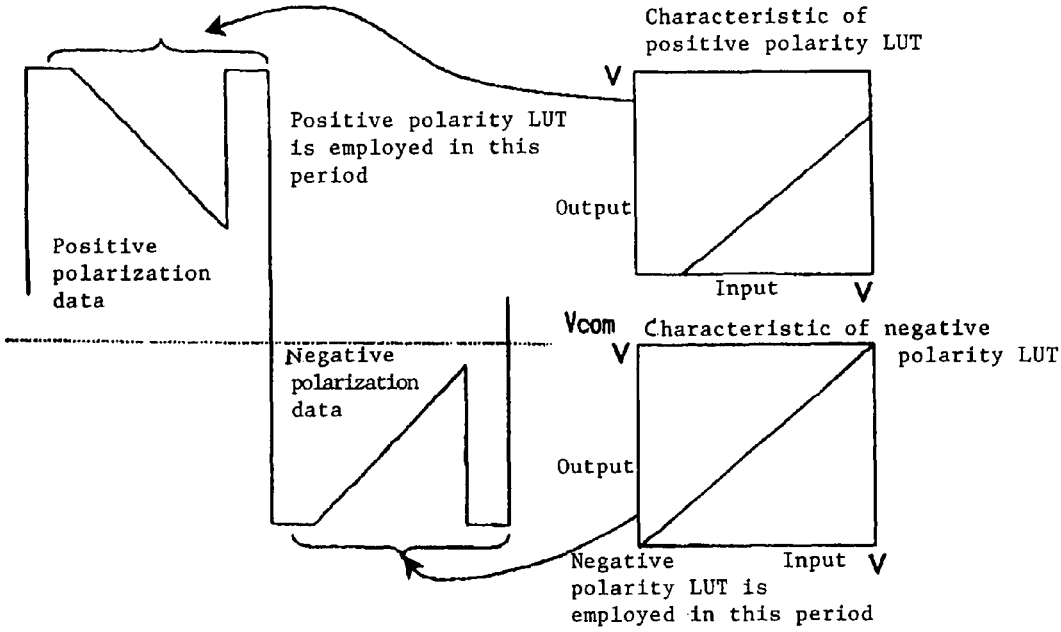
FIG. 5 is a view for explaining an example of characteristics data that are stored in the look-up table (LUT) shown in FIG. 4.

FIG. 5 shows an example of characteristics data that may be stored in LUTs 12*a* and 12*b* for a case in which the brightness when applying image data of positive polarity is greater than the brightness when applying image data of negative polarity. In all of the graphs showing the characteristics of LUTs for positive polarity and negative polarity in FIG. 5, the vertical axis is output (V) and the horizontal axis is input (V). In this case, characteristics data for effecting adjustment to decrease the brightness of display image that is based on image data of positive polarity may be stored in LUT 12*a* to suppress the occurrence of flicker. In other words, as shown in FIG. 5, characteristics data may be stored in LUT 12*a* for uniformly maintaining the output at a minimum value until input reaches a particular value and then increasing the output at a fixed inclination. On the other hand, characteristics data for causing increase at a fixed inclination may be stored in LUT 12*b*.

Storing the characteristics data shown in FIG. 5 in each of LUTs 12*a* and 12*b* may enable adjustment such that the brightness of the display images that are based on image data of positive polarity may be decreased, whereby the difference in brightness between display images that are based on image data of positive polarity and display images that are based on image data of negative polarity may be minimized and the occurrence of flicker suppressed.

In the example shown in FIG. 5, adjustment may be carried out such that the brightness of display images that are based on image data of positive polarity may be decreased by LUT 12*a*, but adjustment may also be carried out such that the brightness of display images that are based on image data of negative polarity may be increased by LUT 12*b* instead. In this case as well, the difference in brightness between the display images that are based on image data of positive polarity and the display images that are based on image data of negative polarity may be reduced and the occurrence of flicker suppressed.

Adjustment may also be carried out in both LUTs 12*a* and 12*b* to reduce the difference in brightness between the display images that are based on image data of positive polarity and the display images that are based on image data of negative polarity. In this case as well, the occurrence of flicker may be suppressed.

Further, in contrast to the example shown in FIG. 5, when the brightness of the display images that are based on image data of negative polarity is greater, the characteristics data of the positive polarity LUT shown in FIG. 5 may be used as the characteristics data of LUT 12*b*, and the characteristics data of the negative polarity LUT shown in FIG. 5 may be used as the characteristics data of positive polarity LUT 12*a*.

Still further, the inclination of the characteristics data stored in LUTs 12*a* and 12*b* need not be fixed and may be any data that may enable adjustment of the brightness of display images.

In the interest of clarifying the explanation of the relation between data stored in LUTs 12*a* and 12*b*, the example shown in FIG. 5 shows a state in which image data were reversed for each line, but the image data may also be reversed at a frequency that is an integer multiple of the frame frequency. Explanation next regards the specifics of the operation of the liquid crystal display device of the present embodiment.

A video signal may be supplied to V-T/gamma correction circuit 10 from the outside, and vertical synchronizing signal Vsyn that is sync-separated from this video signal may be supplied to control signal generation module 14. In V-T/gamma correction circuit 10, the video signal that has been received as input may be subjected to a V-T/gamma correction process. The input video signal contains data (picture element data) for each liquid crystal cell, and may be applied as input to V-T/gamma correction circuit 10 in a state of already having undergone gamma correction. For example, image data received from a broadcast station may have undergone gamma correction that takes into consideration the characteristics of a Braun tube. In V-T/gamma correction circuit 10, the input video signal that has undergone this gamma correction may be subjected to correction (VT correction and gamma correction) that accords with the characteristics of liquid crystal panel 16 for each pixel unit (cell unit).

When the vertical synchronizing signal Vsync is supplied to control signal generation module 14, control signal generation module 14 may generate timing signal Vd of double the input vertical synchronizing signal Vsync and may supply this timing signal Vd to switch circuit 11. Based on timing signal Vd, switch circuit 11 may supply the image data from V-T/gamma correction circuit 10 that have undergone V-T/gamma correction to one of LUTs 12*a* and 12*b*.

In accordance with the characteristics data that have been stored in advance, LUT 12*a* may correct (e.g., adjust the brightness of) the image data that have been supplied by way of switch circuit 11 in pixel units (cell units). Similarly, in accordance with the characteristics data that have been stored in advance, LUT 12*b* may correct (e.g., adjust the brightness of) image data that have been supplied by way of switch circuit 11 in pixel units (cell units). It is here assumed that the characteristics data shown in FIG. 5 may be stored in LUTs 12*a* and 12*b*.

Of the image data from V-T/gamma correction circuit 10 that have undergone V-T/gamma correction, data that are taken to be image data of positive polarity may be supplied to liquid crystal drive circuit 13 by way of LUT 12*a*, and data that are taken to be image data of negative polarity may be supplied to liquid crystal drive circuit 13 by way of LUT 12*b*. Liquid crystal drive circuit 13 may drive liquid crystal panel 16 based on the image data that have been supplied by way of LUTs 12*a* and 12*b*. In liquid crystal panel 16, the common voltage from common voltage generation circuit 15 may be supplied to a shared common electrode in each liquid crystal cell, and image display may be realized based on the image data from liquid crystal drive circuit 13.

According to the liquid crystal display device of the present embodiment described in the foregoing explanation, two types of LUT may be used while switching according to the polarity of the image data, whereby changes in brightness that are apparent to the eye may be minimized and the occurrence of flicker suppressed. As a result, a configuration can be provided in which flicker is difficult to discern in a liquid crystal projector of the high-luminance frame-reversal double-speed drive system. In addition, the use of an LUT configuration may enable a minimization of the influence exerted by the amplitude of the image data.

In addition, the adoption of a configuration in which switching is implemented according to polarity between two LUTs, one for positive polarity and one for negative polarity, can facilitate application not only to liquid crystal panels in which characteristics that arise from polarity have already been ascertained, but also to liquid crystal panels that will be developed in the future and that have as yet unknown characteristics.

The configuration that employs LUTs may further enable driving the liquid crystal panels of a normally white liquid crystal panel and a normally black liquid crystal panel by the same circuit. Switching between normally white and normally black can be easily handled by preparing data in the descending or ascending order of LUT addresses.

In the present embodiment, the independent formation of an LUT for gamma correction and an LUT for flicker suppression may increase the degree of freedom of adjustment of the two LUTs. In this case, moreover, the present embodiment may allow easy adjustment of gamma correction to realize characteristics according to the preferences of the projector operator.

The liquid crystal display device of the present embodiment as described above is only an example of the present invention and its configuration and operation are open to modification as appropriate within the scope that does not diverge from the gist of the present invention. For example, the switch circuit and LUTs may also be arranged in a section that follows the liquid crystal drive circuit.

In addition, when three liquid crystal panels are provided corresponding to the three primary colors R, G, and B, V-T/gamma correction circuit 10, switch circuit 11, LUTs 12*a* and 12*b*, and liquid crystal drive circuit 13 may be provided for each liquid crystal panel. In this case, control signal generation module 14 may generate timing signals for each liquid crystal panel to supply these timing signals to each switch circuit 11. Each liquid crystal panel may also be supplied with a common voltage from the common voltage generation circuit.

Second Embodiment

Figure 6:
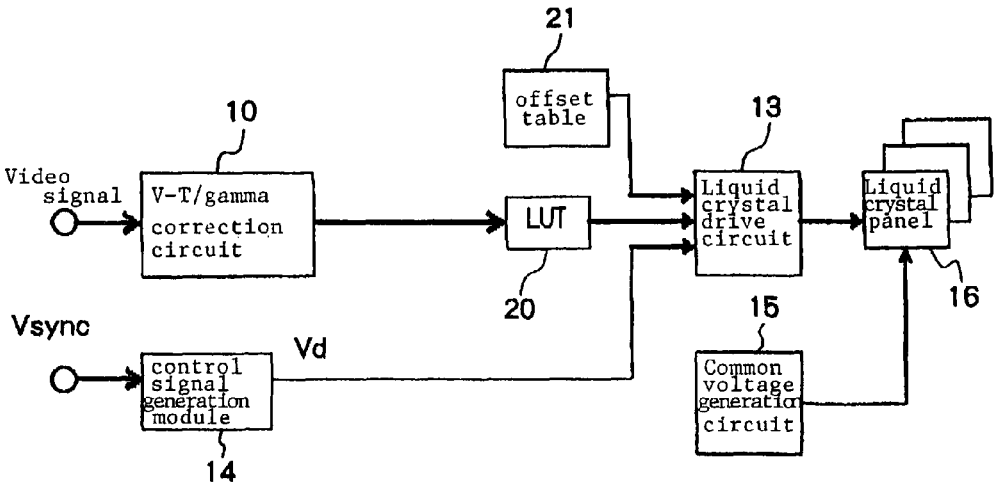
FIG. 6 is a block diagram showing the schematic configuration of the liquid crystal panel drive module of the liquid crystal display device, according to the second embodiment of the present invention.

FIG. 6 is a block diagram showing the schematic configuration of the liquid crystal panel drive module of the liquid crystal display device that is the second exemplary embodiment of the present invention. The liquid crystal panel drive module shown in FIG. 6 may differ from the configuration shown in FIG. 4 in that LUT 20 and offset table 21 may be provided in place of switch circuit 11 and LUTs 12*a* and 12*b*. V-T/gamma correction circuit 10, control signal generation module 14, and common voltage generation circuit 15 may be identical to the components shown in FIG. 4.

Characteristics data for adjusting the brightness of display images that relate to image data of positive polarity or negative polarity may be stored in LUT 20. In offset table 21, characteristics data may be stored for returning (offsetting) the image data in which brightness has undergone adjustment by the characteristics data of LUT 20 to the image data of brightness that preceded adjustment.

Image data from V-T/gamma correction circuit 10 may be supplied to liquid crystal drive circuit 13 by way of LUT 20. Timing signal Vd that has been generated in control signal generation module 14 and the characteristics data of offset table 21 may each be supplied to liquid crystal drive circuit 13. Based on timing signal Vd that has been generated in control signal generation module 14, liquid crystal drive circuit 13 may return those data from among the image data that have been received as input by way of LUT 20 that are taken to be image data of positive polarity or negative polarity to image data of the brightness that preceded adjustment by means of offset table 21. For example, when characteristics data of the LUT for positive polarity shown in FIG. 5 are stored in LUT 20, liquid crystal drive circuit 13 may return those data that are taken to be image data of negative polarity to image data of the brightness that preceded adjustment by means of offset table 21. A process can thus be carried out that may be identical to the process of adjusting brightness using the LUTs for positive polarity and negative polarity shown in FIG. 5.

Although liquid crystal drive circuit 13 may carry out an offset process for making the image data of negative polarity the original brightness in the above-described operation, liquid crystal drive circuit 13 may conversely also carry out an offset process for making the image data of positive polarity the original brightness. In this case, characteristics data for adjusting the brightness of display images that relate to image data of negative polarity may be stored in LUT 20.

The liquid crystal display device of the present embodiment may exhibit the same effects as for the above-described first embodiment.

In addition, adopting a configuration having just one LUT may enable a reduction in circuit scale. The present embodiment may be suitable for an already existing liquid crystal panel drive method in which the liquid crystal characteristics have been ascertained.

Third Embodiment

Figure 7:
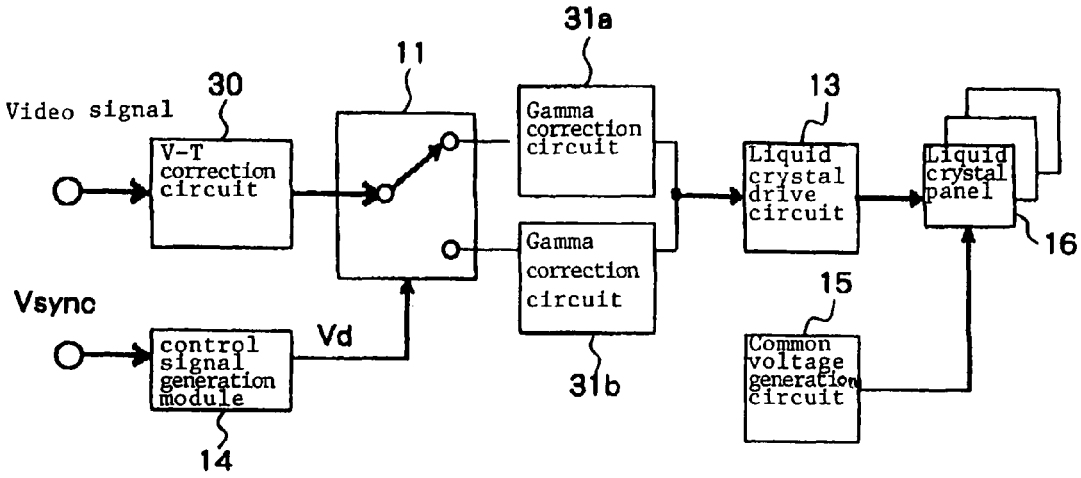
FIG. 7 is a block diagram showing the schematic configuration of the liquid crystal panel drive module of the liquid crystal display device, according to the third embodiment of the present invention.

FIG. 7 is a block diagram showing the schematic configuration of the liquid crystal panel drive module of the liquid crystal display device that is the third exemplary embodiment of the present invention. The liquid crystal panel drive module shown in FIG. 7 may differ from the configuration shown in FIG. 4 in that V-T correction circuit 30 and gamma correction circuits 31*a* and 31*b* may be provided in place of V-T/gamma correction circuit 10 and LUTs 12*a* and 12*b*. Control signal generation module 14 and common voltage generation circuit 15 may be identical to the components shown in FIG. 4.

Figure 8A:
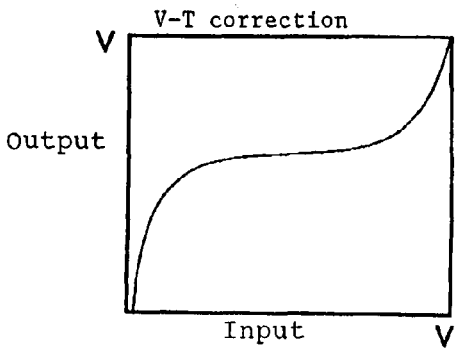
FIG. 8A is a characteristics chart showing an example of the characteristics data of the LUT used in a V-T correction circuit.

V-T correction circuit 30 may be basically identical to the V-T correction circuit that makes up V-T/gamma correction circuit 10 and is made up from an LUT. FIG. 8A shows characteristics data of the LUT used in V-T correction in V-T correction circuit 30. The vertical axis is output (V) and the horizontal axis is input (V). These characteristics data may include data for correcting a video signal supplied from the outside to match the characteristics of liquid crystal panel 16 and may include three spaces: a space in which inclination increases drastically, a space in which the inclination changes gradually, and a space in which the inclination increases drastically.

Gamma correction circuit 31*a* may be composed of one LUT for storing characteristics data for carrying out both gamma correction and brightness adjustment relating to image data of positive polarity (characteristics data in which are combined: the characteristics data of the LUT relating to the gamma correction circuit that makes up V-T/gamma correction circuit 10, and characteristics data relating to LUT 12*a* shown in FIG. 4).

Gamma correction circuit 31*b* may be also composed of one LUT for storing characteristics data for carrying out both gamma correction and adjustment of brightness relating to image data of negative polarity (characteristic data in which are combined: the characteristics data of the LUT relating to the gamma correction circuit that makes up V-T/gamma correction circuit 10, and characteristics data relating to LUT 12*b* shown in FIG. 4). Both of gamma correction circuits 31*a* and 31*b* may be capable of carrying out in a single LUT the processes of gamma correction and brightness adjustment.

Figure 8B:
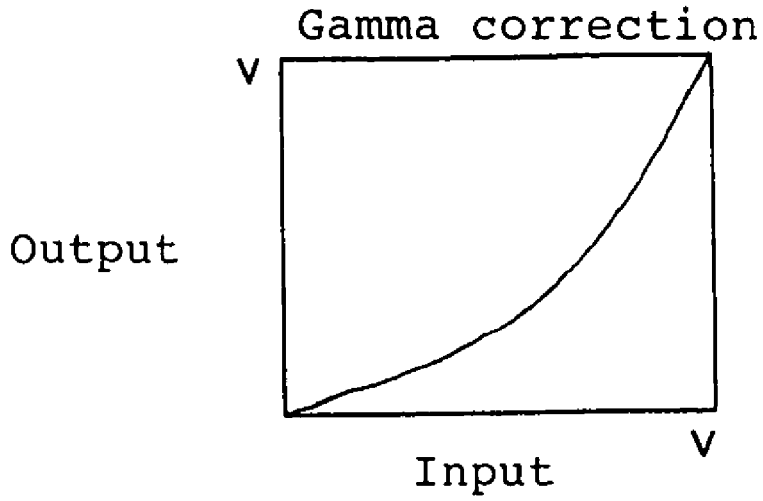
FIG. 8B is a characteristics chart showing an example of the characteristics data of the LUT used in a gamma correction circuit.

FIG. 8B shows the characteristics data of the LUT that may be used in gamma correction. The vertical axis is output (V) and the horizontal axis is input (V).

In the liquid crystal display device of the present embodiment, video signals supplied from the outside may first undergo V-T correction in V-T correction circuit 30 and may then be supplied to switch circuit 11. Based on timing signal Vd from control signal generation module 14, switch circuit 11 may supply, of the image data from V-T correction circuit 30, those data that are taken to be image data of positive polarity to gamma correction circuit 31*a* and may supply data that are taken to be image data of negative polarity to gamma correction circuit 31*b*.

In gamma correction circuit 31*a*, image data from V-T correction circuit 30 (e.g., corresponding to image data of positive polarity) may be subjected to gamma correction and display image brightness adjustment. Similarly, in gamma correction circuit 31*b*, image data from V-T correction circuit 30 (e.g., corresponding to image data of negative polarity) may be subjected to gamma correction and display image brightness adjustment. In this way, adjustment may be realized by means of gamma correction circuits 31*a* and 31*b* that may reduce the difference in brightness between the display images that are based on image data of positive polarity and the display images that are based on image data of negative polarity, thereby enabling suppression of the flicker that is generated when a minute difference occurs between the brightness of image data of positive polarity and image data of negative polarity.

The liquid crystal display device of the present embodiment may also exhibit the same effects as the previously described first embodiment.

In addition, the processes for gamma correction and flicker suppression can be carried out by a single LUT, whereby circuit scale may be reduced from the configuration of the first embodiment. However, the degree of freedom of gamma correction and brightness adjustment that use the LUT may also be reduced.

In addition, V-T correction circuit can be integrated with gamma correction circuits 31*a* and 31*b* to enable a further reduction of circuit scale. However, this configuration may result in a further reduction of the degree of freedom of the V-T correction, gamma correction, and brightness adjustment that use the LUT.

Fourth Embodiment

Figure 9:
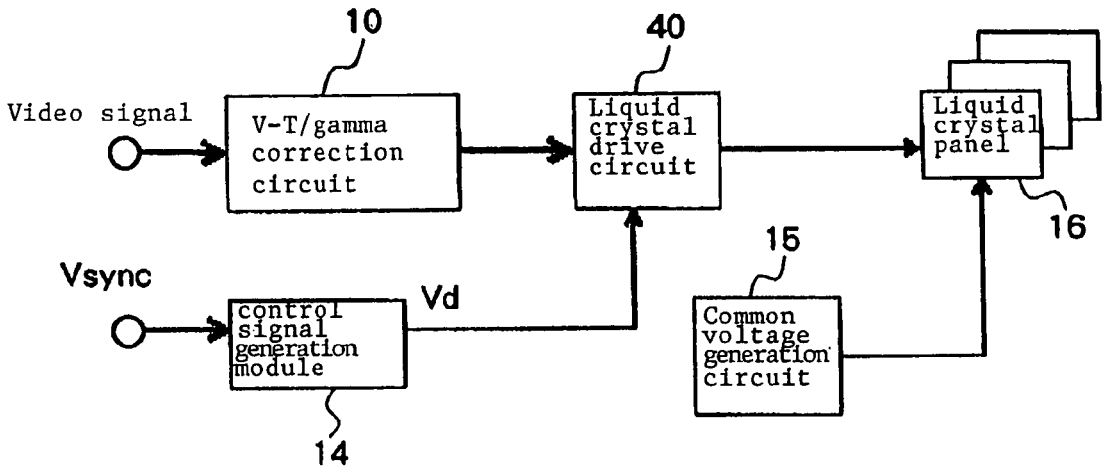
FIG. 9 is a block diagram showing the schematic configuration of the liquid crystal panel drive module of the liquid crystal display device according to the fourth embodiment of the present invention.

FIG. 9 is a block diagram showing the schematic configuration of the liquid crystal panel drive module of the liquid crystal display device that is the fourth exemplary embodiment of the present invention. The liquid crystal panel drive module shown in FIG. 9 may differ from the configuration shown in FIG. 4 in that liquid crystal drive circuit 40 may be provided in place of switch circuit 11, LUTs 12*a* and 12*b*, and liquid crystal drive circuit 13. V-T/gamma correction circuit 10, control signal generation module 14, and common voltage generation circuit 15 may be identical to the components shown in FIG. 4.

Liquid crystal drive circuit 40 may implement control both for supplying liquid crystal cells with voltage that accords with image data that have been received as input from V-T/gamma correction circuit 10 to display images on liquid crystal panel 16, and for reversing the polarity of the voltage supplied to each liquid crystal cell at a frequency that is an integer multiple of the frame frequency of the video signals. Liquid crystal drive circuit 40 may further, based on characteristics data that have been obtained in advance from the minute difference in brightness between image data of positive polarity and image data of negative polarity, adjust the brightness of the display images that are based on image data of positive polarity and the brightness of the display images that are based on image data of negative polarity.

This adjustment circuit may include, for example, an amplitude amplification circuit for increasing and decreasing the amplitude of image data that have been received as input; a black level adjustment circuit for adjusting the black level; and/or a control module for controlling the amplitude by means of the amplitude amplification circuit and the adjustment of level by means of the black level adjustment circuit in accordance with the polarity of the image data.

The present embodiment may enable suppression of flicker by means of a configuration having circuit scale equivalent to the prior art. The present embodiment may be particularly effective for liquid crystal panels in which the amount of divergence from the optimum value of common voltage that results from the amplitude of the image data is comparatively small while the influence due to polarity is dominant. However, control of the amplitude or black level of image data of positive polarity or negative polarity may in some cases result in a reduction of the dynamic range or the occurrence of white-out (or black-out). These problems may be in a trade-off relationship with the perception of flicker.

A normally white/normally black liquid crystal panel can be easily handled by inverting each bit of image data.

In each of the above-described first to fourth embodiments, image data may be adjusted by means of, for example, an LUT to suppress flicker, but an equivalent effect can also be obtained by means of modulation, according to the polarity of image data, of the standard voltage (e.g., reference voltage Vref) that is the standard of the reversal of image data of positive polarity and image data of negative polarity.

The present invention as explained hereinabove can be generally applied to liquid crystal display devices that use AC-drive liquid crystal panels in which the polarity of the voltage supplied to a plurality of liquid crystal cells is reversed at a prescribed period, and in particular, when applied to a liquid crystal display device that employs frame-reversal double-speed drive, exhibits the special effect of suppressing flicker.

While exemplary embodiments of the present invention have been described using specific terms, such description is for illustrates purposes only, and it is to be understood that changes and variations may be made without departing from the spirit or scope of the following claims.

What is claimed is:

1. A liquid crystal display device, comprising:

a liquid crystal panel including a plurality of liquid crystal cells;

a common voltage generation circuit that supplies a common voltage to said liquid crystal panel;

a liquid crystal drive circuit that implements control for supplying said plurality of liquid crystal cells with voltage that accords with a video signal to display an image on said liquid crystal panel, and for reversing a polarity of the voltage supplied to said plurality of liquid crystal cells; and an adjustment module that stores characteristics data for correcting fluctuations in brightness and, based on said characteristics data, adjusts the brightness of said image displayed on said liquid crystal panel, wherein said common voltage generation circuit supplies a fixed common voltage to common electrodes to which said plurality of liquid crystal cells are connected in common, wherein said liquid crystal drive circuit reverses a polarity of the voltage supplied to said plurality of liquid crystal cells at a prescribed period, wherein said adjustment module comprises a memory module for storing said characteristics data for correcting fluctuations in brightness that originate from the polarity and amplitude of voltage supplied to said liquid crystal cells, wherein said adjustment module adjusts the brightness of display images that are based on image data of positive polarity for which the polarity of said voltage is taken as positive and the brightness of display images that are based on image data of negative polarity for which the polarity of said voltage is taken as negative, wherein the liquid crystal display device further comprises a control signal generation module that generates a timing signal that is an integer multiple of a vertical synchronizing signal that indicates a frame period of said video signal that is received as input, wherein said memory module comprises:

a first look-up table in which are stored characteristics data for adjusting the brightness of display images that are based on said image data of positive polarity; and a second look-up table in which are stored characteristics data for adjusting the brightness of display images that are based on said image data of negative polarity, wherein said adjustment module further comprises:

a switch circuit that receives said video signal as input, and that, based on the timing signal generated by said control signal generation module, selectively supplies the input video signal to one of said first and said second look-up tables, and wherein image data that have been adjusted by said first and second look-up tables are supplied to said liquid crystal drive circuit.

2. A liquid crystal display device, comprising:

a liquid crystal panel including a plurality of liquid crystal cells;

a common voltage generation circuit that supplies a common voltage to said liquid crystal panel;

a liquid crystal drive circuit that implements control for supplying said plurality of liquid crystal cells with voltage that accords with a video signal to display an image on said liquid crystal panel, and for reversing a polarity of the voltage supplied to said plurality of liquid crystal cells; and an adjustment module that stores characteristics data for correcting fluctuations in brightness and, based on said characteristics data, adjusts the brightness of said image displayed on said liquid crystal panel, wherein said common voltage generation circuit supplies a fixed common voltage to common electrodes to which said plurality of liquid crystal cells are connected in common, wherein said liquid crystal drive circuit reverses a polarity of the voltage supplied to said plurality of liquid crystal cells at a prescribed period, wherein said adjustment module comprises a memory module for storing said characteristics data for correcting fluctuations in brightness that originate from the polarity and amplitude of voltage supplied to said liquid crystal cells, wherein said adjustment module adjusts the brightness of display images that are based on image data of positive polarity for which the polarity of said voltage is taken as positive and the brightness of display images that are based on image data of negative polarity for which the polarity of said voltage is taken as negative, wherein the liquid crystal display device further comprises a control signal generation module that generates a timing signal that is an integer multiple of a vertical synchronizing signal that indicates a frame period of said video signal received as input from the outside, wherein said memory module comprises:

a first look-up table in which are stored characteristics data for adjusting the brightness of display images that are based on said image data of positive polarity; and a second look-up table in which are stored characteristics data for adjusting the brightness of display images that are based on said image data of negative polarity, wherein said adjustment module further comprises:

a switch circuit that receives the output signal of said liquid crystal drive circuit as input, and that, based on the timing signal generated by said control signal generation module, selectively supplies the input signal to either one of said first and second look-up tables, and wherein image data that have been adjusted by said first and second look-up tables are supplied to said liquid crystal panel.

3. A liquid crystal display device, comprising:

a liquid crystal panel including a plurality of liquid crystal cells;

a common voltage generation circuit that supplies a common voltage to said liquid crystal panel;

a liquid crystal drive circuit that implements control for supplying said plurality of liquid crystal cells with voltage that accords with a video signal to display an image on said liquid crystal panel, and for reversing a polarity of the voltage supplied to said plurality of liquid crystal cells; and an adjustment module that stores characteristics data for correcting fluctuations in brightness and, based on said characteristics data, adjusts the brightness of said image displayed on said liquid crystal panel, wherein said common voltage generation circuit supplies a fixed common voltage to common electrodes to which said plurality of liquid crystal cells are connected in common, wherein said liquid crystal drive circuit reverses a polarity of the voltage supplied to said plurality of liquid crystal cells at a prescribed period, wherein said adjustment module comprises a memory module for storing said characteristics data for correcting fluctuations in brightness that originate from the polarity and amplitude of voltage supplied to said liquid crystal cells, wherein said adjustment module adjusts the brightness of display images that are based on image data of positive polarity for which the polarity of said voltage is taken as positive and the brightness of display images that are based on image data of negative polarity for which the polarity of said voltage is taken as negative, wherein the liquid crystal display device further comprises a control signal generation module that generates a timing signal that is an integer multiple of a vertical synchronizing signal that indicates a frame period of said video signal that is received as input from the outside, wherein said memory module further comprises:

a first look-up table in which are stored characteristics data for both carrying out gamma correction of said video signal and adjusting the brightness of display images that are based on said image data of positive polarity; and a second look-up table in which are stored characteristics data for both carrying out gamma correction of said video signal and adjusting the brightness of display images that are based on said image data of negative polarity, wherein said adjustment module further comprises:

a switch circuit that receives said video signal as input and that, based on the timing signal generated by said control signal generation module, selectively supplies the input video signal to either one of said first and second look-up tables, and wherein image data that have been adjusted by said first and second look-up tables are supplied to said liquid crystal drive circuit.

4. A liquid crystal display device, comprising:

a liquid crystal panel including a plurality of liquid crystal cells;

a common voltage generation circuit that supplies a common voltage to said liquid crystal panel;

a liquid crystal drive circuit that implements control for supplying said plurality of liquid crystal cells with voltage that accords with a video signal to display an image on said liquid crystal panel, and for reversing a polarity of the voltage supplied to said plurality of liquid crystal cells; and an adjustment module that stores characteristics data for correcting fluctuations in brightness and, based on said characteristics data, adjusts the brightness of said image displayed on said liquid crystal panel, wherein said common voltage generation circuit supplies a fixed common voltage to common electrodes to which said plurality of liquid crystal cells are connected in common, wherein said liquid crystal drive circuit reverses a polarity of the voltage supplied to said plurality of liquid crystal cells at a prescribed period, wherein said adjustment module comprises a memory module for storing said characteristics data for correcting fluctuations in brightness that originate from the polarity and amplitude of voltage supplied to said liquid crystal cells, wherein said adjustment module adjusts the brightness of display images that are based on image data of positive polarity for which the polarity of said voltage is taken as positive and the brightness of display images that are based on image data of negative polarity for which the polarity of said voltage is taken as negative, wherein said adjustment module further comprises a look-up table in which are stored characteristics data for adjusting the brightness of display images that are based on said image data of positive polarity or negative polarity, wherein said liquid crystal display device further comprises:

an offset table in which are stored characteristics data for returning said image data of positive polarity or negative polarity for which brightness has been adjusted by said look-up table to image data of the brightness that preceded the adjustment; and a control signal generation module for generating a timing signal that is an integer multiple of a vertical synchronizing signal that indicates the frame period of said video signal that has been received as input from the outside, and wherein said liquid crystal drive circuit receives said video signal as input by way of said look-up table and, based on the timing signal that is generated by said control signal generation module, returns, of the input video signal, said image data of positive polarity or negative polarity to image data of the brightness that preceded adjustment by said offset table.

5. An adjustment module for a liquid crystal display device having a liquid crystal panel, comprising:

a memory module for storing characteristics data for correcting fluctuations in brightness in said liquid crystal panel, wherein based on said characteristics data, said adjustment module adjusts the brightness of display images that are based on image data of positive polarity for which the polarity of said voltage is taken as positive, and the brightness of display images that are based on image data of negative polarity for which the polarity of said voltage is taken as negative, wherein said liquid crystal display device further comprises a liquid crystal drive circuit and a control signal generation module that generates a timing signal that is an integer multiple of a vertical synchronizing signal that indicates a frame period of said video signal that is received as input from the outside, and wherein said adjustment module further comprises:

plural look-up tables for storing characteristics data for adjusting the brightness of display images that are based on said image data of positive polarity and said image data of negative polarity; and a switch circuit that receives said video signal as input, and that, based on the timing signal generated by said control signal generation module, selectively supplies the input video signal to a look-up table in said plurality of look-up tables.

6. An adjustment module for a liquid crystal display device having a liquid crystal panel, comprising:

a memory module for storing characteristics data for correcting fluctuations in brightness in said liquid crystal panel, wherein based on said characteristics data, said adjustment module adjusts the brightness of display images that are based on image data of positive polarity for which the polarity of said voltage is taken as positive, and the brightness of display images that are based on image data of negative polarity for which the polarity of said voltage is taken as negative, wherein said liquid crystal display device further comprises a liquid crystal drive circuit and a control signal generation module that generates a timing signal that is an integer multiple of a vertical synchronizing signal that indicates a frame period of said video signal that is received as input from the outside, wherein said adjustment module further comprises:

plural look-up tables for storing characteristics data for adjusting the brightness of display images that are based on said image data of positive polarity and said image data of negative polarity; and a switch circuit that receives said video signal as input, and that, based on the timing signal generated by said control signal generation module, selectively supplies the input video signal to a look-up table in said plurality of look-up tables, and wherein said plural look-up tables comprise:

a first look-up table in which are stored characteristics data for adjusting the brightness of display images that are based on said image data of positive polarity; and a second look-up table in which are stored characteristics data for adjusting the brightness of display images that are based on said image data of negative polarity.

7. The adjustment module of claim 6, wherein image data that have been adjusted by said first and second look-up tables are supplied to said liquid crystal drive circuit.

* * * * *